United States Patent [19]

Easley

[11] Patent Number: 4,960,161

[45] Date of Patent: Oct. 2, 1990

[54] READY-MADE CURTAIN SYSTEM INCLUDING SWAGS AND JABOTS

[76] Inventor: Madlyn Easley, 75 Brightwood La., West Hartford, Conn. 06110

[21] Appl. No.: 457,179

[22] Filed: Dec. 26, 1989

Related U.S. Application Data

[63] Continuation-in-part of Ser. No. 3,547, Jan. 15, 1987.

[51] Int. Cl.[5] ..... A47H 1/00

[52] U.S. Cl. ..... 160/126; 160/330

[58] Field of Search ..... 160/126, 330, 348, 349.1, 160/349.2, 124, 123, 405

[56] References Cited

U.S. PATENT DOCUMENTS

| | | | |
|---|---|---|---|
| 1,708,107 | 4/1929 | Plotkin | 160/330 |
| 2,329,462 | 9/1943 | Friedberg | 160/330 |
| 2,547,697 | 4/1951 | Gallo | 160/330 |
| 2,588,256 | 3/1952 | Lepow | 160/330 X |
| 2,815,807 | 12/1957 | Loos | 160/330 X |
| 3,151,345 | 10/1964 | Massop | 160/330 X |
| 3,181,594 | 5/1965 | Shapiro | 160/330 X |
| 3,321,004 | 5/1967 | Lopes | 160/330 |
| 3,399,711 | 9/1968 | Stulac et al. | 160/330 |

*Primary Examiner*—David M. Purol

*Attorney, Agent, or Firm*—Ira S. Dorman

[57] ABSTRACT

A ready-made swag and jabot system has, as installed, at least two laterally overlapped swags mounted upon the more rearward of a pair of parallel curtain rods, draped from that position over the forward rod to hang in front of the jabots that is supports.

18 Claims, 6 Drawing Sheets

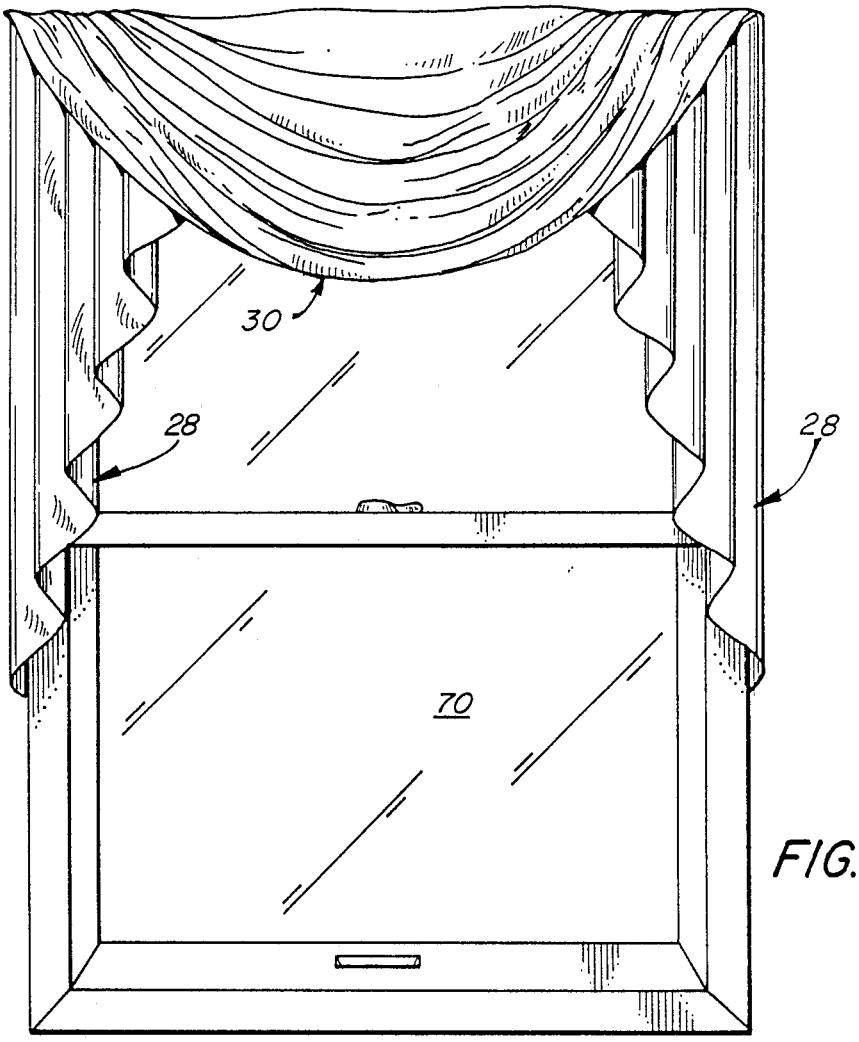
FIG. 7
FIG. 8
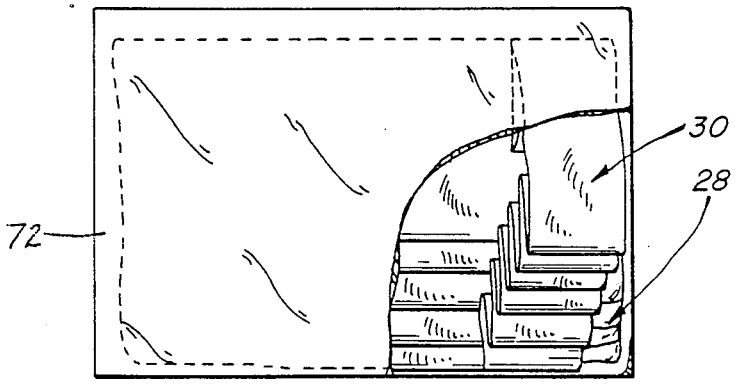

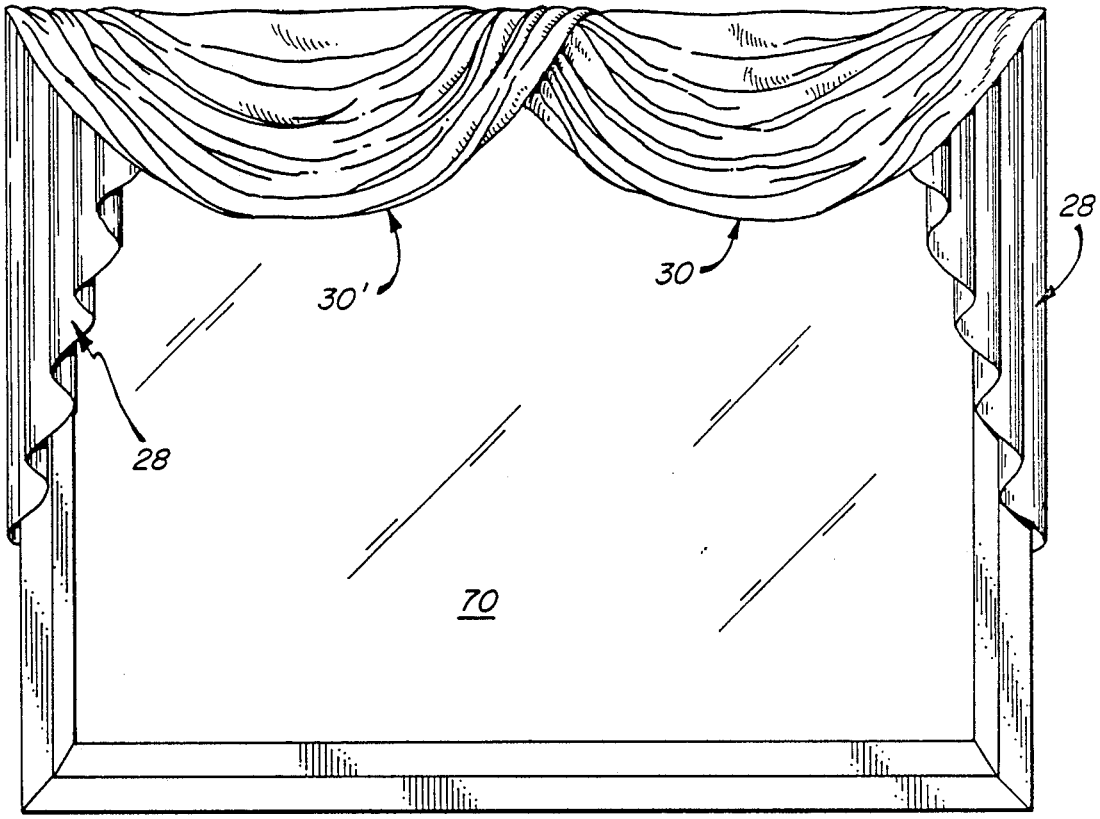
FIG. 9
FIG. 10
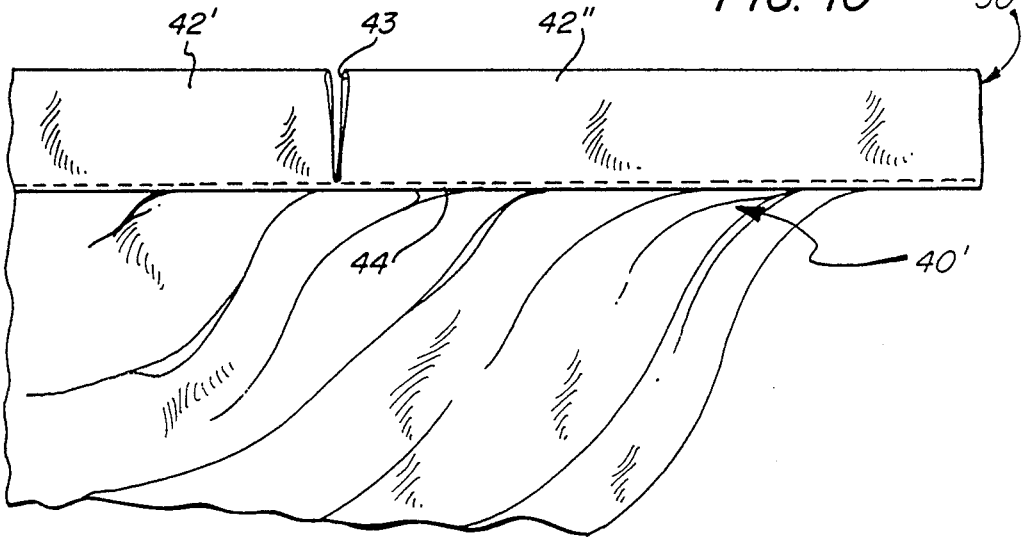

READY-MADE CURTAIN SYSTEM INCLUDING SWAGS AND JABOTS

CROSS REFERENCE TO RELATED APPLICATION

This application is a continuation-in-part of co-pending application Ser. No. 07/003,547, filed on Jan. 15, 1987.

BACKGROUND OF THE INVENTION

A style of window treatment that is currently in popular use is known as a "swag and jabot curtain" system, a typical installation of which is shown in FIGS. 1 and 2 of the appended drawings. At present, such curtain systems are normally custom-made to order, and fitted to a particular window; they therefore tend to be quite expensive, they are not adapted for production in volume, and professional installation is generally required.

Accordingly, it is the broad object of the present invention to provide a novel, ready-made swag and jabot curtain set, and a novel system including the same.

It is also an object of the invention to provide such a set and system which are highly attractive, facile to install, and relatively inexpensive to manufacture.

Another object of the invention is to provide a ready-made swag and jabot curtain set which is adapted for sale in packaged condition to the retail market, and for installation by the customer.

An additional object is to provide such a curtain set comprising at least two swag components disposed side-by-side in overlapping relationship.

A further object is to provide a novel method for the decoration of a window or the like, using a ready-made curtain set.

SUMMARY OF THE INVENTION

It has now been found that certain of the foregoing and related objects of the invention are readily attained by the provision of a curtain system comprising a pair of parallel curtain rods, one mounted behind the other and in substantially the same horizontal plane; a pair of jabots mounted in laterally spaced relationship on the forward rod; and at least two swags mounted side-by-side on the rearward rod and draped over the forward one. Each jabot includes a panel that is folded upon itself and secured in that condition, to provide a multiplicity of permanent lengthwise folds, and has a laterally extending pocket thereon, advantageously provided by a strip piece fastened against the back surface of the panel and joined along the top edge thereof and at a level spaced downwardly therefrom. The laterally extending pocket on the jabot serves to receive the forward rod, and a sleeve piece is provided on the panel of each of the swags to define a similar pocket thereon, through at least a portion of which the rearward rod is received. The sleeve piece of one or both of the swags has at least one opening located along the expanse of the attached panel, to permit passage of the rearward rod therethrough and to define a free portion to one side thereof. As installed, the free portion can overlap an adjacent portion of the other swag, with the panels thereof draped in front of the upper portions of the jabots. The system additionally includes means, such as a spring clip, for fastening the free portion of the "one" swag to the rearward rod, superimposed over the adjacent portion of the "other" swag.

The opening in the sleeve piece of the overlapping swag will preferably be disposed at a point intermediate the ends thereof, and will conveniently be made by severing the sleeve piece at an appropriate location along its length. Alternatively, the opening may simply be at one end of a sleeve piece that terminates along the expanse of the attached panel. Normally, the jabots and the swags will be made of a supple fabric, and preferably the tops of the jabots will be substantially free from conspicuous stitching, or other fastening elements, exposed on its front surface; the seams that join the strip piece to the top of the jabot panels will desirably be disposed on top of the mounting rod, since this will lend positional stability to the system.

Further objects of the invention are attained by the provision of a ready-made swag and jabot curtain set; by the provision of a package assembly including such a set; and by a method for the installation thereof. In those embodiments the swag and jabot have the features hereinabove described.

The method of the invention, more particularly, involves the steps of inserting one of the rods through the pockets of the jabots to dispose them thereon in spaced apart relationship; inserting the other rod through the pocket of the sleeve piece of a first one of the swags, and through only a portion of the pocket in the sleeve piece of the second swag, the rod exiting through the opening therein and leaving a free (unsupported) portion therebeyond; and mounting the rods with the "one" rod disposed in front of the "other" rod and substantially in the same horizontal plane. The swags are thereafter arranged centrally on their mounting rods, with the free portion of the "second" swag overlapping an adjacent portion of the "first" swag; the securing means is applied to fasten the free portion of the "second" swag to the "other" rod, in superimposed relationship to the adjacent portion of the "first" swag; and the swag panels are extended forwardly over the "one" rod to drape at least partially in front of the upper portions of the jabots.

BRIEF DESCRIPTION OF THE DRAWINGS

FIG. 7 is an elevational view showing the curtain system installed and employed as a window treatment;

FIG. 8 is a perspective view of a package assembly embodying the invention;

FIG. 9 is a front elevational view showing a second curtain system embodiment of the invention installed and employed as a window treatment;

FIG. 10 is a fragmentary elevational view showing, from the back, the top portion of a swag used in the system of FIG. 9, drawn to a scale enlarged therefrom;

DETAILED DESCRIPTION OF THE ILLUSTRATED EMBODIMENT

Figure 1:
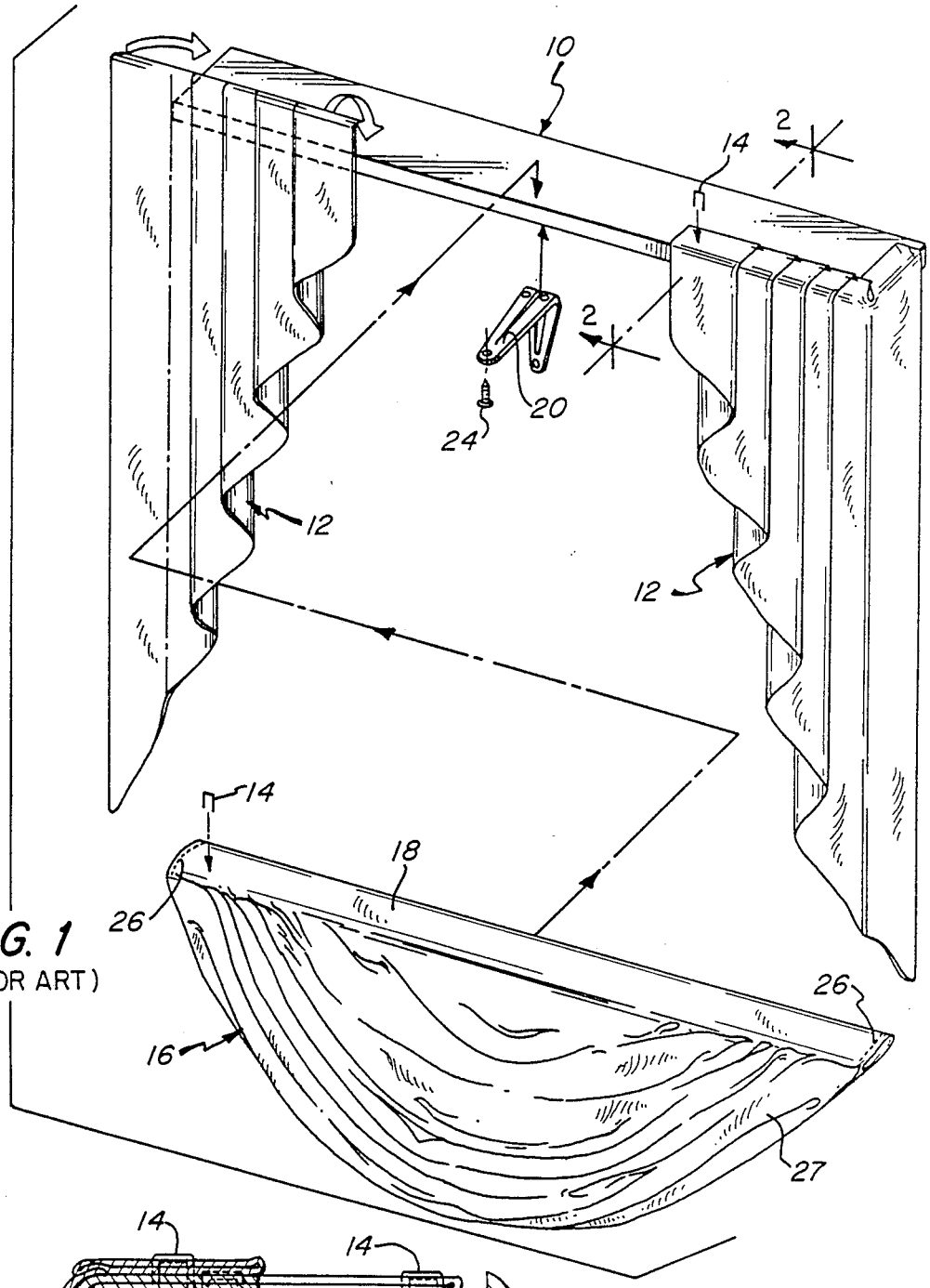
FIG. 1 (PRIOR ART)
FIG. 1 is an exploded perspective view showing the components constituting a typical custom installation of a swag and jabot window curtain treatment.
Figure 2:
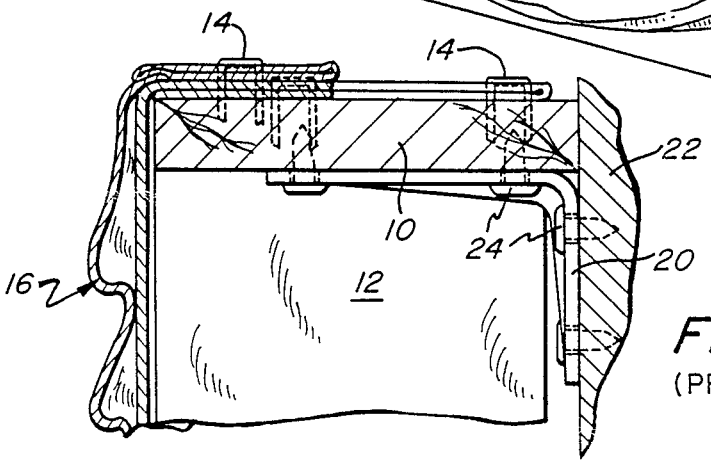
FIG. 2 (PRIOR ART)
FIG. 2 is a fragmentary sectional view of the prior art installation of FIG. 1 with the components assembled, taken along line 2—2 thereof and drawn to an enlarged scale.
Figure 3:
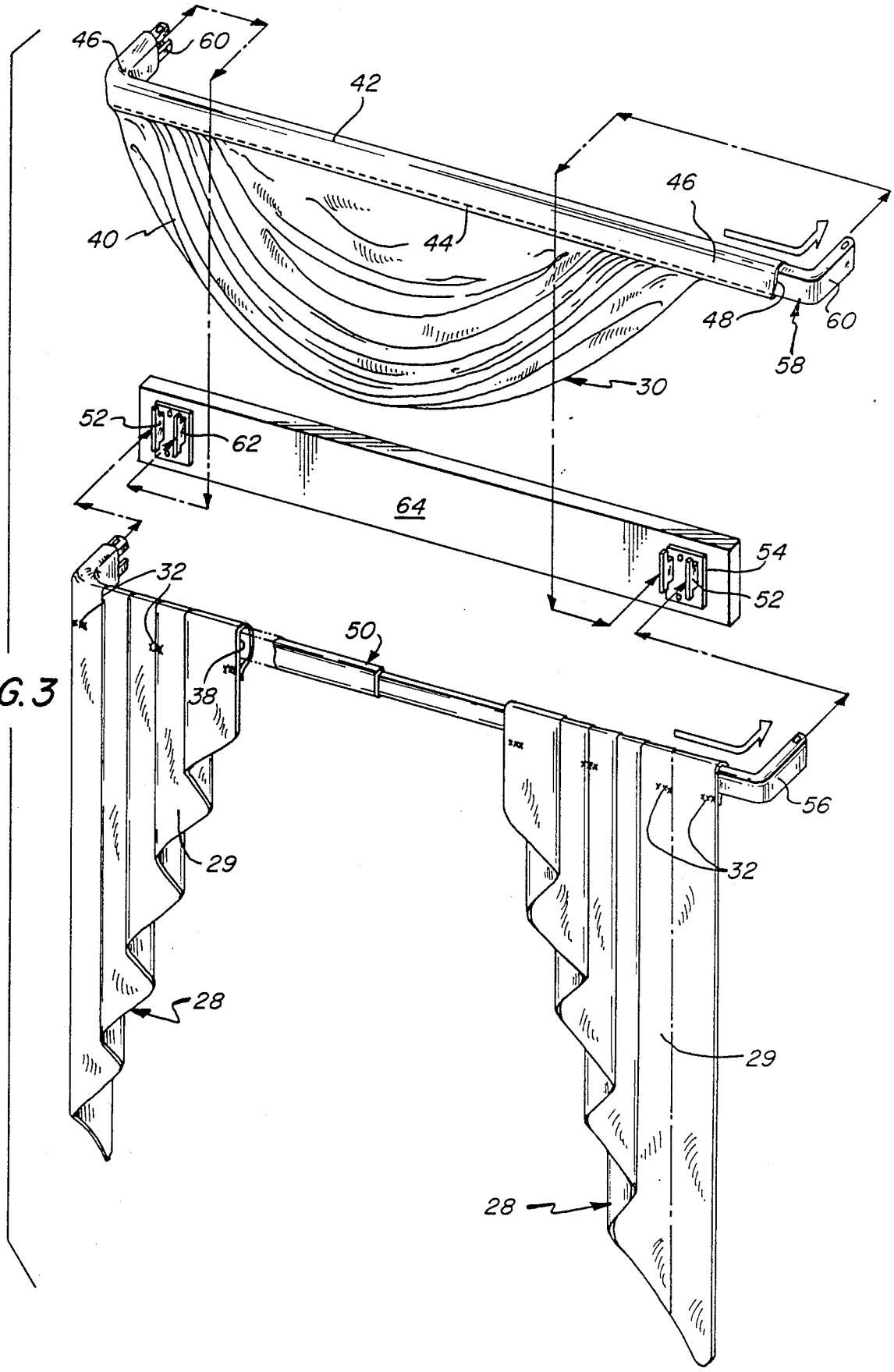
FIG. 3 is an exploded perspective view of a curtain system embodiment of the present invention, also showing a molding piece and fixtures for mounting the supporting rods.
Figure 4:
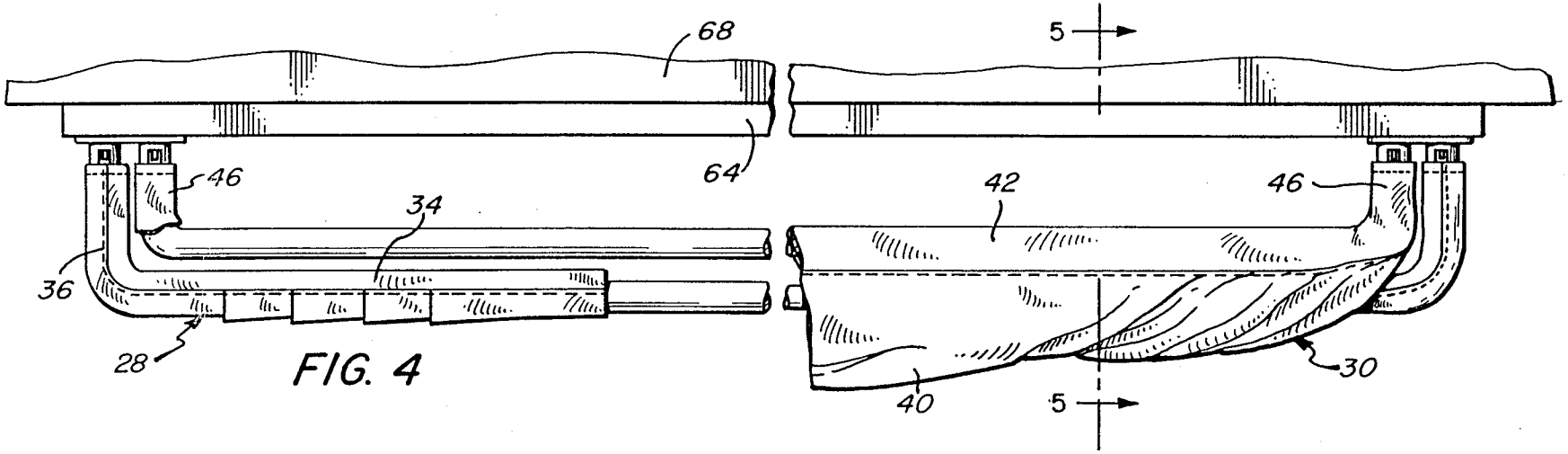
FIG. 4 is a fragmentary plan view of the system of FIG. 3, drawn to a somewhat enlarged scale.
Figure 6:
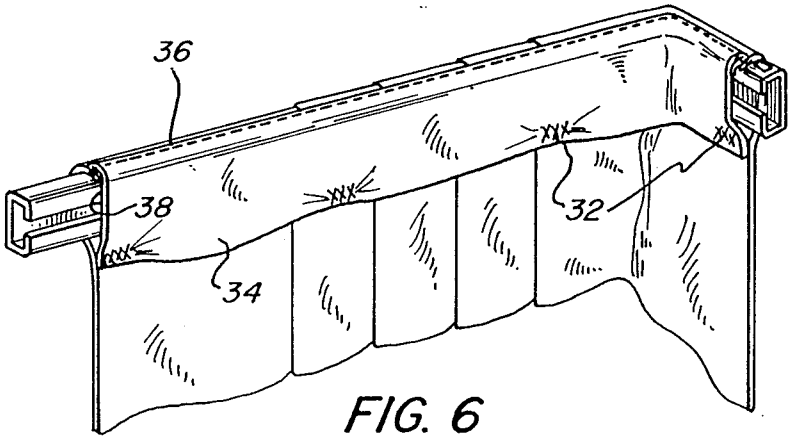
FIG. 6 is a fragmentary perspective view showing the back of the top portion of one of the jabots, and a section of the rod on which it is mounted.

Turning now in detail to the appended drawings, FIGS. 1 and 2 illustrate a conventional, custom swag and jabot window curtain treatment installation. The arrangement consists of a mounting board 10 to which a pair of jabot panels, generally designated by the numeral 12, are attached. As can be seen, the panels 12 are folded upon themselves to define a series of lengthwise pleats, and they are fastened along the forward and end margins of the board 10 by wire staples 14. The swag, generally designated by the numeral 16, consists of a draped panel 27 attached to a flat, double-ply strip piece 18, which is similarly stapled to the board 10 along the forward margin. The preassembly may then be installed in suitable position in front of a window by supporting the board 10 upon angle brackets 20 (only one of them is shown), which are affixed thereto and to the wall 22 by screws 24. For ease of installation and neatness, the ends of the two-ply strip piece 18 are normally stitched closed, as at 26. FIG. 7 may be considered to illustrate the appearance of both the prior art custom installation and also a system and curtain set embodiment of the invention, despite the fundamental differences in their respective construction.

Turning now in detail to FIGS. 3–6 of the drawings, therein illustrated is a system embodying the present invention. The curtain set consists of a pair of jabots, each generally designated by the numeral 28, and a swag designated by the numeral 30, all made from a supple cloth or fabric. The jabots 28 consist of a panel 29 folded upon itself in a series of lengthwise pleats, which are of permanent form and are maintained by the several short lines of stitching 32, known as "bar tacking," and virtually unnoticeable as a practical matter. A strip of fabric 34 is fastened to the back of each panel 29, and is secured along its lower edge by the same bar tacking as at 32; it is sewn to the top edge of the panel along its opposite margin by a continuous line of stitching at 36. The strip piece 34 cooperates with the panel 29 to form a sleeve-like structure defining an elongated, laterally extending pocket 38. Use of added piece 34 avoids the bulkiness that would result if the pleated panel 29 were merely folded upon itself to produce a pocket, as would not only be unduly cumbersome but would also require more substantial (and therefore more conspicuous) means of securement.

The swag 30 consists of the curved, gently folded hanging piece 40 and the elongated sleeve piece 42, along which the hanging piece 40 is affixed by a line of stitching 44. As can be seen, opposite end portions 46 of the sleeve piece 42 extend laterally beyond the hanging piece 40, and an elongated-open ended pocket 48 is defined along the entire length thereof.

The swag 30 and jabots 28 are hung on conventional telescoping curtain rods. The jabots 30 are mounted in laterally spaced relationship upon the forward rod, generally designated by the numeral 50, simply by inserting it through the respective pockets 38 and engaging the outer lug 52 of the two fixtures 54 within the open ends of its return portions 56. The swag 30 is similarly supported upon the inner rod, generally designated by the numeral 58, by inserting it through pocket 48 of its sleeve piece 46. The return portions 60 of the rod 58, which are engaged upon the inner pair of lugs 62, are shorter than the corresponding portions 56, and consequently the sleeve piece 42 is disposed behind the pocket-forming components of the jabots 28, but at the same height. Small nails 66 are used to affix the fixtures 54 to the molding piece 64, which is attached to the wall 68. Such installations are of course commonly used for other styles of curtains and drapes.

Figure 5:
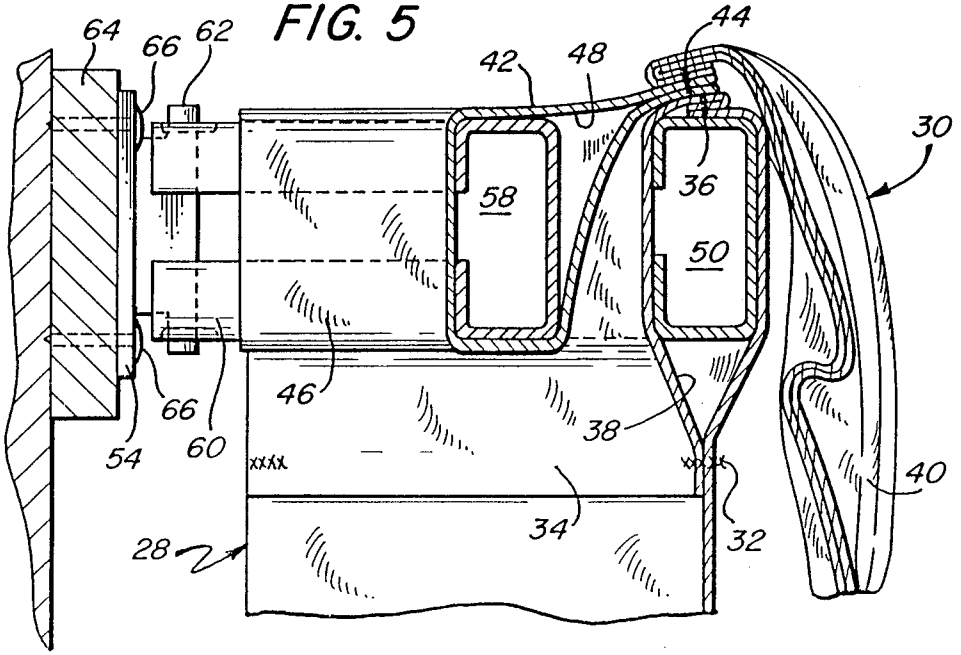
FIG. 5 is a fragmentary sectional view of the system, drawn to a further enlarged scale.
Figure 11:
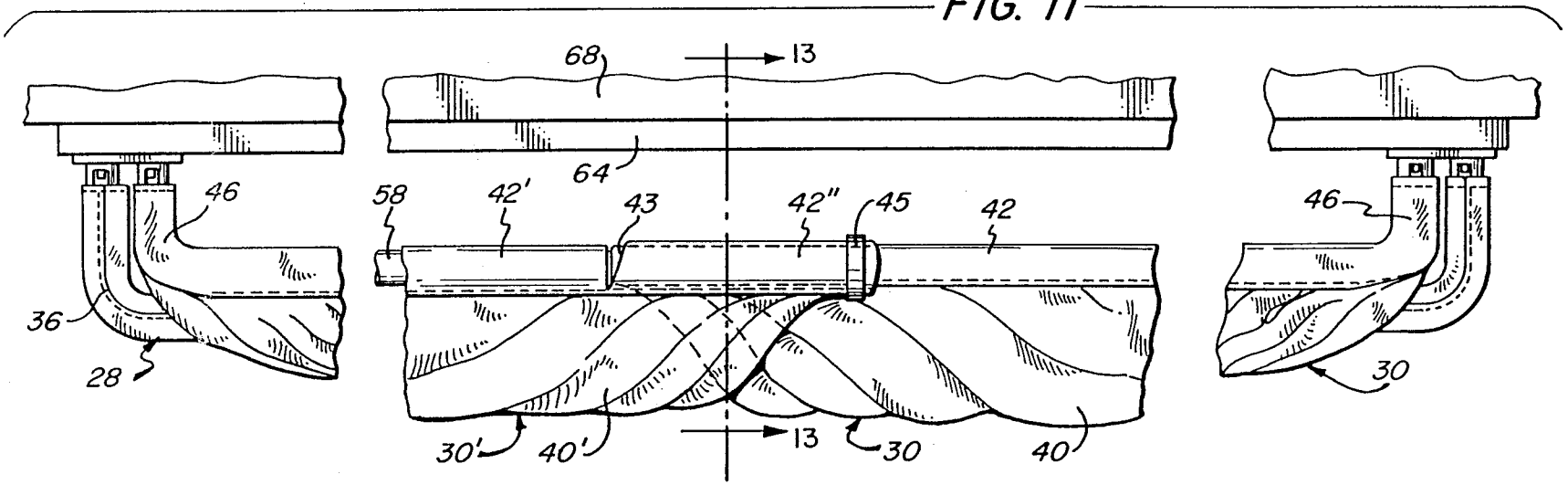
FIG. 11 is a fragmentary plan view of the system of FIG. 9.
Figure 12:
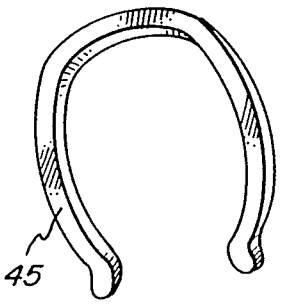
FIG. 12 is a sectional view taken along line 12—12 of FIG. 11.
Figure 13:
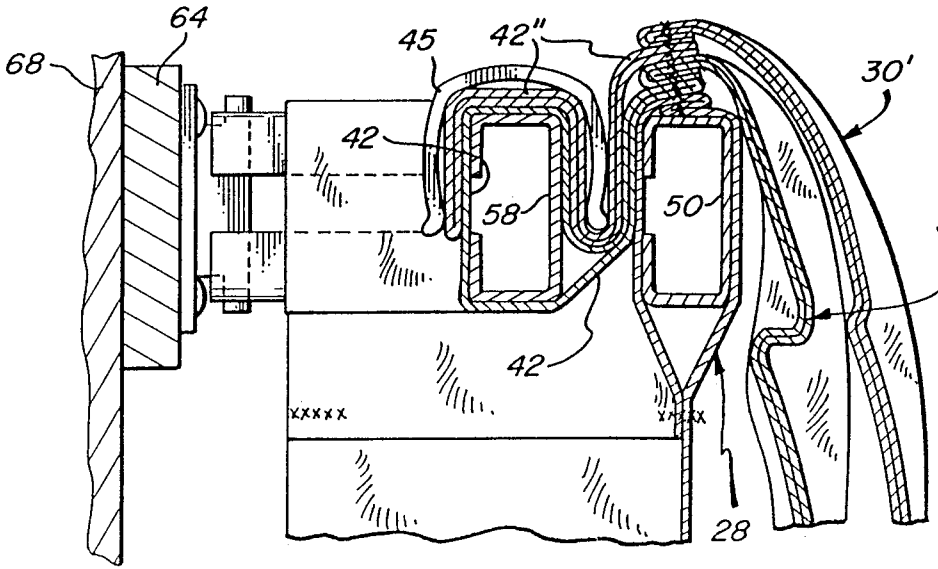
FIG. 13 is a perspective view of a spring clip used in the system of FIGS. 9, 11 and 12.

As best seen in FIG. 5, after the swag and jabots have been mounted in the manner described the swag panel 40 is extended forwardly from its mounting rod 58 and draped over the rod 50, to hang in front of the upper portions of the jabots; this produces the arrangement shown in FIG. 7. The swag panel 40 is sufficiently wide to cover the full expanse of the jabots 28 and the space between them, so as to produce a graceful decoration for the window 70, fully as attractive and finished in appearance as are the custom installations. The instant curtain set does so however while also providing the simplicity of manufacture and ease of installation afforded by a ready-made article.

Turning now to FIG. 8, therein depicted is a package consisting of the swag and jabot sets described herein, further folded into a compact configuration and contained within a plastic bag 72. The manner in which the several pieces are folded to produce the package is of course a matter of relative unimportance, as is the particular kind of container utilized. Rather, novelty of the package assembly resides in the provision of a ready-made swag and jabot set which is adapted to be so packaged.

With specific reference now to FIGS. 9–13 of the drawings, the embodiment of the invention shown therein comprises a pair of side-by-side swags, generally designated by the numerals 30, 30′, disposed in overlapping relationship, both swags 30, 30′ being mounted upon the rearward rod 58 and being draped over the forward rod 50, all substantially as hereinabove described. The construction of swag 30 is also substantially as previously described, and the swag 30′ is virtually the same except for the modification thereto that is best seen with reference to FIGS. 10 and 11.

Thus, the hanging piece or panel 40′ of swag 30′ is attached to an elongated sleeve piece, consisting of two sections 42′, 42″ separated by a slit at 43. The slit may conveniently be produced by cutting an integrally formed, unitary sleeve piece from the top edge to a point near the line of stitching 44, at a location along the expanse (i.e., between the lateral extremities) of the panel 40′. The overlapped relationship of the swags 30, 30′ is achieved by inserting the rearward rod 58 through only the section 42′ of the sleeve piece, exiting therefrom through the slit 43 and leaving the section 42″ unmounted, and free. The adjacent end of the sleeve piece 42 of the swag 30 is then brought to a position against, or closely proximate, the end of the mounted section 42′ that terminates at the slit 43, with the free section 42″ thereafter being superimposed over the proximate section of the sleeve piece 42. Finally, the section 42″ is secured in place on the rod 58 by applying the resilient plastic spring clip 45.

It will be appreciated that the means for permitting exit of the rod 58 from the sleeve piece of swag 30' may vary from that which is illustrated, and may be in the form of an opening of any suitable size and shape through only the inner ply (as mounted) of the sleeve piece. Indeed, the opening may simply constitute the end of a sleeve piece that is shorter than the attached panel is wide, so as to cause the rod to exit from the pocket thereof at a location along the expanse of the panel. In such a case the free portion of the swag panel may have a tab or equivalent element thereon, to permit attachment to the rod in the superimposed relationship described.

It will also be understood that the curtain set of this embodiment may comprise three or more overlapped swags (even though only two have been shown in FIGS. 9 and 11), and that variations in the pattern of superimposition is also possible. For example, when three or more swags are employed the right end of each may overlap the left end of the one adjacent to it (or vice versa), or an intermediate swag may overlap (or be overlapped) at both of its ends by each of the two adjacent swags; in such instances two openings for the rod will of course have to be provided in the sleeve piece of at least one of the swags.

As indicated above the various pieces from which the swag and jabot of the invention are constructed will generally be of cloth or supple fabric; however, other materials may be employed, should it be desired to do so. Similarly, the means for fastening together the several pieces of the components, and the various portions thereof, will normally constitute lines of stitching, but here again substitutions can be made. Since the upper end portion of the jabots are normally partially exposed in an installation of this kind, it is important in any event that the fastening means employed thereat be quite inconspicuous; bar tacking represents one possibility among the alternatives that will occur to those skilled in the art. The means for securing the free end portion of the swag upon the mounting rod may also take a wide variety of forms, and alternatives to the plastic clip illustrated will be readily apparent.

Thus, it can be seen that the present invention provides a novel, ready-made swag and jabot curtain set, including two swags that are adapted to be hung side-by-side in overlapping relationship, and a novel system and method utilizing the same. The curtain set and system are highly attractive, facile to install, and relatively inexpensive to manufacture; the set is adapted for sale in packaged condition to the retail market, and for do-it-yourself installation by the customer.

Having thus described the invention, what is claimed is:

1. A curtain system comprising: a pair of parallel curtain rods, one mounted behind the other and in substantially the same horizontal plane; a pair of jabots mounted on the forward rod, each including a panel that is folded upon itself and secured in that condition to provide a multiplicity of permanent folds extending lengthwise thereof, and each having a laterally extending pocket along the top edge of said panel through which said forward rod is received; at least two swags mounted on the rearward rod, each including a panel that is draped over said forward rod, and a sleeve piece on said panel providing a laterally extending pocket through at least a portion of which said rearward rod is received, said sleeve piece of at least one of said swags having at least one opening at a location along the expanse of said panel thereof adapted to permit passage of said rearward rod therethrough out of said pocket thereof, and defining a free portion of said swag to one side of said opening, said swags being disposed side-by-side on said rearward rod with said free portion of said one swag overlapping an adjacent portion of the other of said swags, said panels of said swags overlapping one another and hanging in front of upper portions of said jabots; and securing means for fastening said free portion of said one swag, superimposed over said adjacent portion of said other swag, to said rearward rod.

2. The system of claim 1 wherein said opening of said one swag is provided along the length of said sleeve piece thereof, and wherein said free portion includes a portion of said sleeve piece of said one swag.

3. The system of claim 2 wherein said opening of said one swag is provided by severing said sleeve piece thereof.

4. The system of claim 1 wherein a strip piece is fastened against the back surface of said panel of each of said jabots and joined along the top edge thereof and also at a level spaced downwardly therefrom to provide a laterally extending pocket through which said forward rod is received, wherein said folds extend at least substantially to the upper edge of said forward rod, and wherein said jabots are substantially free from conspicuous stitching or other fastening elements exposed on the front surface thereof.

5. The system of claim 2 wherein said folds are pleats, and wherein said strip piece and panel of each of said jabots are joined along said top edge by a seam that is disposed upon and extends along the top of said forward rod, to afford positional stability to said jabots.

6. The system of claim 2 wherein said sleeve piece of said one swag has two openings along the length thereof, to permit said one swag to overlap, at both ends thereof, an adjacent swag.

7. A curtain system comprising: a pair of parallel curtain rods, one mounted behind the other and in substantially the same horizontal plane; a pair of jabots mounted on the forward rod; at least two swags mounted on the rearward rod, each of said jabots including a panel that is folded upon itself and secured in that condition to provide a multiplicity of permanent folds extending lengthwise thereof, and each having a laterally extending pocket through which said forward rod is received, said folds extending at least substantially to the upper edge of said forward rod, each of said swags including a panel that is draped over said forward rod, and a sleeve piece on said panel providing a laterally extending pocket through at least a portion of which said rearward rod is received, said sleeve piece of at least one of the said swags having at least one opening along the length thereof, and at a location along the expanse of said panel thereof, adapted to permit passage of said rearward rod therethrough out of said pocket thereof, and defining a free portion to one side thereof, said swags being disposed side-by-side on said rearward rod with said free sleeve portion of said one swag overlapping said sleeve piece of the other of said swags, said panels of said swags overlapping one another and hanging in front of upper portions of said jabots; and securing means for fastening said free sleeve portion of said one swag; superimposed over said sleeve piece of said other swag, to said rearward rod.

8. The system of claim 7 wherein said sleeve piece of said one swag has two openings along the length thereof, to permit said one swag to overlap, at both ends thereof, an adjacent swag.

9. A ready made swag and jabot curtain set, comprising at least two swags and a pair of jabots adapted to be hung on two parallel rods for the cooperative decoration of a window, each of said jabots including a panel folded upon itself and secured in that condition to provide a multiplicity of permanent folds extending lengthwise thereof, and each having a laterally extending pocket along the top edge of said panel through which one of the rods may be received; each of said swags including a panel and a sleeve piece extending along one side thereof, said sleeve piece providing a laterally extending pocket through which the other rod may be received, said sleeve piece of at least one of said swags having at least one opening at a location along the expanse of said panel thereof adapted to permit the rod on which said swags are mounted to pass therethrough out of said pocket, whereby the swags can be disposed side-by-side on the rod with a free portion of said one swag, defined to one side of said opening, overlapping an adjacent portion of the other of said swags, said curtain set also including securing means for fastening said free portion of said one swag to the mounting rod in superimposition over said adjacent portion of said other swag.

10. The curtain set of claim 9 wherein said sleeve piece of said one swag has two openings along the length thereof, to permit said one swag to overlap, at both ends thereof, an adjacent swag.

11. The curtain set of claim 10 including at least three of said swags.

12. A package assembly including: (a) a ready-made swag and jabot curtain set comprising at least two swags and a pair of jabots adapted to be hung on two parallel rods for the cooperative decoration of a window, each of said jabots including a panel folded upon itself and secured in that condition to provide a multiplicity of permanent folds extending lengthwise thereof, and each having a laterally extending pocket along the top edge of said panel through which one of the rods may be received; each of said swags including a panel and a sleeve piece extending along one side thereof, said sleeve piece providing a laterally extending pocket through which the other rod may be received, said sleeve piece of at least one of said swags having at least one opening at a location along the expanse of said panel thereof adapted to permit the rod on which said swags are mounted to pass therethrough out of said pocket thereof, whereby the swags can be disposed side-by-side on the rod with a free portion of said one swag, defined to one side of said opening, overlapping an adjacent portion of the other of said swags, said curtain set also including securing means for fastening said free portion of said one swag to the mounting rod in superimposition over said adjacent portion of said other swag, said jabots and swags being further folded to a configuration of reduced overall dimensions for commercial packaging; and (b) a container for said set, said jabots and said swags in said further folded configuration, and said securing means, being disposed entirely within said container.

13. The assembly of claim 12 wherein said opening of said one swag is provided along the length of said sleeve piece thereof, and wherein said free portion includes a portion of said sleeve piece.

14. The assembly of claim 13 wherein said sleeve piece of said one swag has two openings along the length thereof, to permit said one swag to overlap, at both ends thereof, an adjacent swag.

15. The assembly of claim 14 including at least three of said swags.

16. A method for decoration of a window or the like comprising the steps:

(a) providing a ready made swag and jabot curtain set, comprising at least two swags and a pair of jabots adapted to be hung on two parallel rods, each of said jabots including a panel folded upon itself and secured in that condition to provide a multiplicity of permanent folds extending lengthwise thereof, and each having a laterally extending pocket along the top edge of said panel through which one of the rods may be received; each of said swags including a panel and a sleeve piece extending along one side thereof, said sleeve piece providing a laterally extending pocket through at least a portion of which the other rod may be received, said sleeve piece of at least one of said swags having at least one opening at a location along the expanse of said panel thereof adapted to permit the rod on which said swags are mounted to pass therethrough out of said pocket thereof, whereby the swags can be disposed side-by-side on the rod with a free portion of said one swag, defined to one side of said opening, overlapping an adjacent portion of of the other of said swags, said curtain set also including securing means for fastening said free portion of said one swag to the mounting rod in superimposition over said adjacent portion of said other swag;

(b) inserting one rod through said pockets of said jabots to dispose them thereon in spaced apart relationship;

(c) inserting another rod through said pocket of said other swag sleeve piece, and through only the portion of said pocket of said sleeve piece of said one swag disposed to the opposite side of said opening, with said another rod passing therefrom through said opening;

(d) mounting said rods to supporting structure with said one rod in front of said another rod and substantially in the same horizontal plane;

(e) arranging said swags centrally on said another rod with said free portion of said one swag overlapping an adjacent portion of said other swag;

(f) applying said securing means to fasten said free portion of said one swag to said another rod in superimposed relationship to said adjacent portion of said other swag; and (g) extending said swag panels forwardly over said one rod to drape at least partially in front of upper portions of said jabots.

17. The method of claim 16 wherein said opening of said one swag is provided along the length of said sleeve piece thereof, and wherein said free portion includes a portion of said sleeve piece, said free portion being arranged to overlap said sleeve piece of said other swag in said step (e), and being secured in superimposition thereto in said step (f).

18. The method of claim 17 wherein said sleeve piece of said one swag has two openings along the length thereof, to permit said one swag to overlap, at both ends thereof, an adjacent swag.

* * * * *